US008445043B2

(12) United States Patent
Jackson et al.

(10) Patent No.: US 8,445,043 B2
(45) Date of Patent: May 21, 2013

(54) MULTI-TEMPERATURE AND MULTI-TEXTURE FROZEN FOOD MICROWAVE HEATING TRAY

(75) Inventors: Daniel C. Jackson, Wexford, PA (US); Christopher P. Rowoth, Cranberry Township, PA (US); Elizabeth Ritchey, Cranberry Township, PA (US); William J. Rodgers, Cranberry Township, PA (US); Amber Fisher Koehler, Pittsburgh, PA (US)

(73) Assignee: H.J. Heinz Company, Pittsburgh, PA (US)

( * ) Notice: Subject to any disclaimer, the term of this patent is extended or adjusted under 35 U.S.C. 154(b) by 199 days.

(21) Appl. No.: 12/982,486

(22) Filed: Dec. 30, 2010

(65) Prior Publication Data

US 2011/0256284 A1 Oct. 20, 2011

Related U.S. Application Data

(60) Provisional application No. 61/291,161, filed on Dec. 30, 2009.

(51) Int. Cl.
*B65D 81/34* (2006.01)

(52) U.S. Cl.
USPC ..... 426/107; 426/394; 206/561; 206/563; 220/23.8; 219/728; 219/729

(58) Field of Classification Search
USPC .. 426/107, 394; 206/561, 563, 564; 220/23.8, 220/23.2; 219/728, 729
See application file for complete search history.

(56) References Cited

U.S. PATENT DOCUMENTS

| | | | | |
|---|---|---|---|---|
| 2,228,998 | A * | 1/1941 | Birdseye | 62/381 |
| 2,714,070 | A | 4/1950 | Welch | |
| 2,600,566 | A | 6/1952 | Moffett, Jr. | |
| 3,219,460 | A | 11/1965 | Brown | |
| 3,271,169 | A | 9/1966 | Baker et al. | |
| 3,547,661 | A | 12/1970 | Stevenson | |
| 3,615,713 | A | 10/1971 | Stevenson | |
| 3,985,991 | A | 10/1976 | Levinson | |
| 3,985,992 | A | 10/1976 | Goltsos | |
| 4,013,798 | A | 3/1977 | Goltsos | |

(Continued)

FOREIGN PATENT DOCUMENTS

| | | |
|---|---|---|
| EP | 2 040 998 A2 | 4/2009 |
| EP | 2 049 406 A1 | 4/2009 |

(Continued)

OTHER PUBLICATIONS

IQF Technology, Dias Group Products [on line] 2010 no month, retrieved on Sep. 26, 2012. Retrieved from the Internet: <URL: http://www.diassa.gr/article252.aspx>.*

(Continued)

*Primary Examiner* — Rena L. Dye
*Assistant Examiner* — Chaim Smith
(74) *Attorney, Agent, or Firm* — Greenblum & Bernstein, P.L.C.

(57) ABSTRACT

A multi-temperature and multi-texture frozen food microwave heating tray includes a first integral compartment defined by at least one sidewall and an upwardly convex bottom, and a second integral compartment defined by at least one sidewall and a bottom and comprising a microwave energy access modulating structure for one of the first and second compartments.

35 Claims, 11 Drawing Sheets

U.S. PATENT DOCUMENTS

| | | | | |
|---|---|---|---|---|
| 4,080,524 | A | | 3/1978 | Greenfield et al. |
| 4,081,646 | A | | 3/1978 | Goltsos |
| 4,122,324 | A | | 10/1978 | Falk |
| 4,133,996 | A | | 1/1979 | Fread |
| 4,144,435 | A | | 3/1979 | Clark et al. |
| 4,190,757 | A | | 2/1980 | Turpin et al. |
| 4,204,105 | A | | 5/1980 | Leveckis et al. |
| 4,233,325 | A | | 11/1980 | Slangan et al. |
| 4,266,108 | A | | 5/1981 | Anderson |
| 4,345,133 | A | | 8/1982 | Cherney et al. |
| 4,351,997 | A | | 9/1982 | Mattisson et al. |
| 4,450,334 | A | | 5/1984 | Bowen et al. |
| 4,486,640 | A | | 12/1984 | Bowen et al. |
| 4,503,307 | A | | 3/1985 | Campbell et al. |
| 4,594,492 | A | | 6/1986 | Maroszek |
| 4,626,641 | A | | 12/1986 | Brown |
| 4,689,458 | A | | 8/1987 | Levendusky et al. |
| 4,703,148 | A | | 10/1987 | Mikulski et al. |
| 4,835,942 | A | * | 6/1989 | Skrmetta ..... 53/453 |
| 4,851,631 | A | | 7/1989 | Wendt |
| 4,866,234 | A | | 9/1989 | Keefer |
| 4,874,917 | A | | 10/1989 | Weimer |
| 4,883,936 | A | | 11/1989 | Maynard |
| 4,894,503 | A | | 1/1990 | Wendt |
| 4,926,020 | A | | 5/1990 | Atwell et al. |
| 4,972,058 | A | | 11/1990 | Benson et al. |
| 4,972,059 | A | | 11/1990 | Wendt et al. |
| 4,973,502 | A | | 11/1990 | Holzmüller et al. |
| 5,021,293 | A | | 6/1991 | Huang |
| 5,053,594 | A | | 10/1991 | Thota et al. |
| 5,057,331 | A | | 10/1991 | Levinson |
| 5,079,396 | A | | 1/1992 | Katz et al. |
| 5,126,518 | A | | 6/1992 | Beckett |
| 5,126,520 | A | | 6/1992 | Nottingham et al. |
| 5,260,537 | A | | 11/1993 | Beckett |
| 5,288,962 | A | | 2/1994 | Lorence et al. |
| 5,370,883 | A | | 12/1994 | Saunier |
| 5,424,517 | A | | 6/1995 | Habeger, Jr. et al. |
| 5,558,798 | A | | 9/1996 | Tsai |
| 5,593,610 | A | | 1/1997 | Minerich et al. |
| 5,698,127 | A | | 12/1997 | Lai et al. |
| 5,718,370 | A | | 2/1998 | Lafferty et al. |
| 5,736,718 | A | | 4/1998 | Levinson |
| 5,961,872 | A | | 10/1999 | Simon et al. |
| 5,986,248 | A | | 11/1999 | Matsuno et al. |
| 6,054,697 | A | | 4/2000 | Woodward et al. |
| 6,102,281 | A | | 8/2000 | Lafferty et al. |
| 6,229,131 | B1 | | 5/2001 | Koochaki |
| 6,231,903 | B1 | | 5/2001 | Ji et al. |
| 6,410,896 | B2 | | 6/2002 | Witonsky et al. |
| 6,486,455 | B1 | | 11/2002 | Merabet |
| 6,501,059 | B1 | | 12/2002 | Mast |
| 6,696,677 | B2 | | 2/2004 | Kennedy |
| 6,717,121 | B2 | | 4/2004 | Zeng |
| 6,777,655 | B2 | | 8/2004 | Zhang et al. |
| 7,154,073 | B2 | | 12/2006 | Iwai et al. |
| 7,476,830 | B2 | | 1/2009 | Middleton et al. |
| 7,482,560 | B2 | | 1/2009 | Golden et al. |
| 7,491,416 | B2 | | 2/2009 | Zhang et al. |
| 2004/0084445 | A1 | | 5/2004 | Weijer et al. |
| 2004/0238534 | A1 | | 12/2004 | Mast |
| 2006/0118552 | A1 | | 6/2006 | Tiefenback |
| 2007/0029316 | A1 | | 2/2007 | Fernandez |
| 2007/0237867 | A1 | | 10/2007 | Kratochvil et al. |
| 2008/0099474 | A1 | | 5/2008 | Carmichael et al. |
| 2009/0039076 | A1 | | 2/2009 | Maslowski et al. |
| 2009/0042705 | A1 | | 2/2009 | Maslowski et al. |
| 2009/0084781 | A1 | | 4/2009 | Middleton et al. |
| 2009/0200364 | A1 | | 8/2009 | Oliveira |
| 2009/0208614 | A1 | | 8/2009 | Sharma et al. |
| 2009/0294439 | A1 | | 12/2009 | Lai et al. |
| 2009/0304872 | A1 | | 12/2009 | Chouikhi |
| 2010/0230403 | A1 | | 9/2010 | Hodson et al. |

FOREIGN PATENT DOCUMENTS

| | | | |
|---|---|---|---|
| JP | 10-170004 | A | 6/1998 |
| KR | 10-2000-0009950 | | 2/2000 |
| KR | 10-2004-0043022 | | 5/2004 |
| WO | WO2007/141140 | A2 | 12/2007 |
| WO | WO 2007/144572 | A2 | 12/2007 |
| WO | WO 2008/022016 | A1 | 2/2008 |

OTHER PUBLICATIONS

Search Report and Written Opinion mailed Sep. 28, 2011 for International Application No. PCT/US2010/003269.

English Translation of International Preliminary Report on Patentability and Written Opinion for International Application No. PCT/US2010/003269, mailed Jul. 12, 2012.

* cited by examiner

FIG. 21
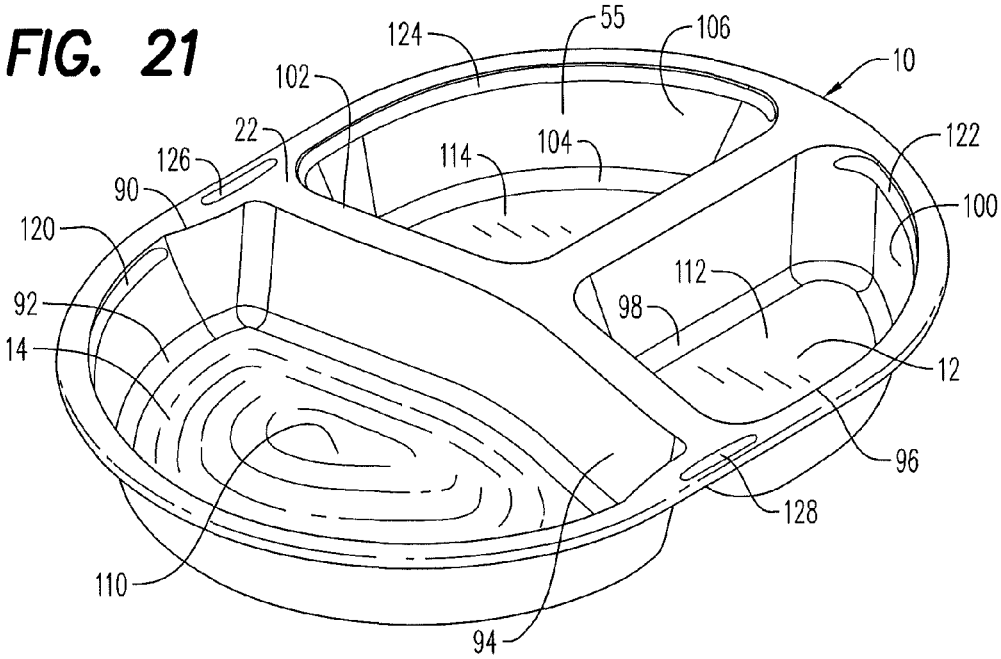
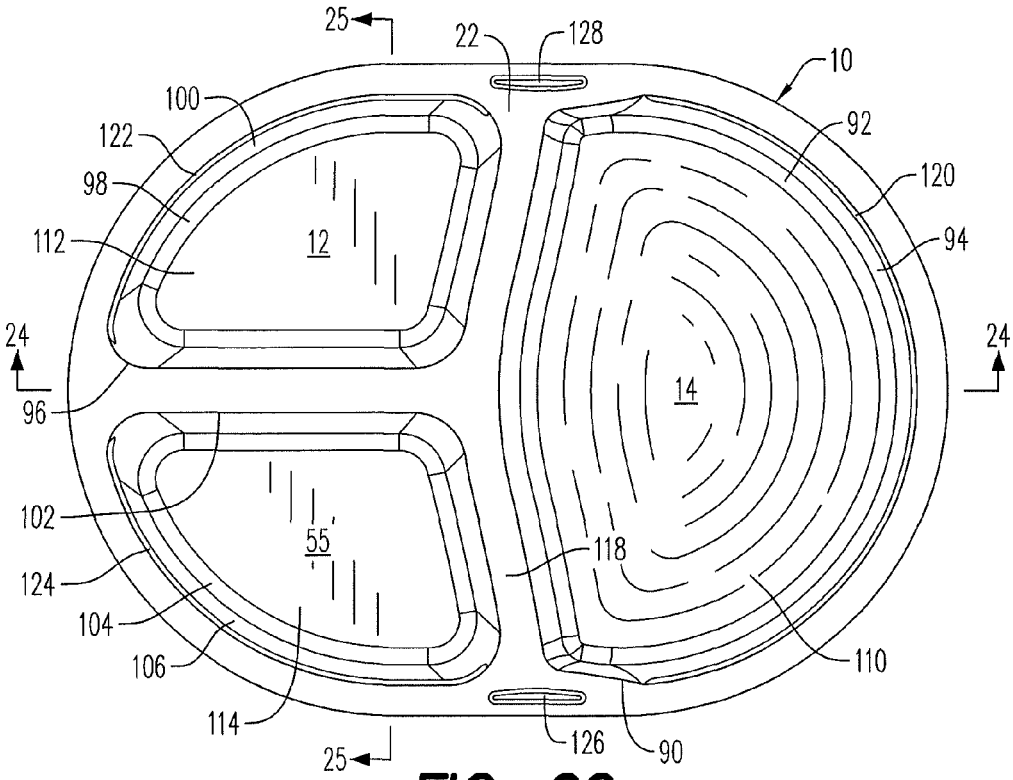
FIG. 22

MULTI-TEMPERATURE AND MULTI-TEXTURE FROZEN FOOD MICROWAVE HEATING TRAY

CROSS-REFERENCE TO RELATED APPLICATION

This application is based on, and claims priority of, U.S. Provisional Application Ser. No. 61/291,161, filed Dec. 30, 2009, the entire content of which is incorporated herein by this reference thereto.

BACKGROUND

Microwave heating trays typically include one or more compartments for heating one or more types of food. However, when different types of quantity of foods are heated in the same heating tray, uneven heating can occur.

The prior art discloses multi-compartment heating trays for microwavable foods. For example, U.S. Pat. No. 7,476,830 discloses microwave packaging for heating a plurality of different food items. The packaging includes multiple compartments for separating food items and one or more microwave energy interactive materials.

This specification generally concerns a multi-temperature and multi-texture microwave heating tray that is operable to uniformly heat different types of foods at the same time. More particularly, this specification describes a microwave heating tray including a first integral compartment defined by at least one sidewall and a bottom having an upwardly convex central portion and a lower, outer edge, and a second integral compartment including a means for limiting microwave energy access entering the second compartment.

SUMMARY OF SELECTED ASPECTS OF THE INVENTION

A microwave heating support according to this disclosure preferably includes a tray having a smoothly contoured peripheral shape and formed of a microwave safe material. The tray includes a first integral compartment defined by at least one sidewall and an upwardly convex bottom, and a second integral compartment defined by at least one sidewall and a bottom. The bottom of the second integral compartment is generally planar. The first integral compartment is spaced from the second integral compartment by a distance ranging from about 0.125 inch to about 0.75 inch. Adjacent portions of the sidewalls of the first integral compartment and the second integral compartment diverge in a downward direction. The smoothly contoured peripheral shape is selected from the group consisting of round, elliptical, and oval contours.

When used in packaging, the first integral compartment typically contains a first quantity of a first food and the second integral compartment contains a second quantity of a second food. The first and second quantities of food may have different densities and microwave heating properties (e.g., dielectric and thermal properties). For example, the first food may be more dense than the second food. One or both food items can be in the form of pellets, if desired.

The tray may also include a microwave energy limiting structure at least partially covering either or both of the compartments. The microwave energy limiting structure functions to adjust the microwave energy reaching the compartments in a predetermined way and may include a material selected from the group consisting of foil, microwave absorbing material, microwave transmitting material, microwave reflecting material, and combinations thereof. Moreover, the microwave energy limiting structure may include at least one opening, hole, gap, or the like, operable to further adjust the amount of microwave energy passing through the limiting or modulating means.

The upwardly convex bottom preferably has a domed central portion and a lower, outer edge. The food located at the lower, outer edge of the first compartment may be thicker than the food located above the domed central portion. The domed central portion is offset from the lower, outer edge by a maximum distance of about 0.1 inch to about 1.0 inch.

A microwave package or container preferably includes a tray having a smoothly contoured peripheral shape and fabricated or formed of a microwave-safe material. The tray includes a first integral compartment defined by at least one sidewall and an upwardly convex bottom, a second integral compartment defined by at least one sidewall and a bottom, microwave energy limiting structure associated with the second integral compartment, a first quantity of a first food contained in the first integral compartment, and a second quantity of a second food contained in the second integral compartment. The bottom of the second integral compartment is generally planar. The first integral compartment is spaced laterally from the second integral compartment by a distance ranging from about 0.125 inch to about 0.75 inch. Adjacent portions of the sidewalls of the first integral compartment and the second integral compartment diverge in a downward direction.

The microwave energy limiting structure functions to modify the quantity of microwave energy applied to the associated compartment and the associated quantity of food. To that end, the microwave energy limiting structure may include a material selected from the group consisting of foil, microwave absorbing material, microwave transmitting material, microwave reflecting material, and combinations thereof. The microwave energy limiting structure may also include one or more openings, holes, or gaps therein. Preferably, the microwave energy limiting structure is removable from the tray to expose the protected food item. For example, the film lid used to control or modulate microwave energy can be removed to expose the protected food. The bottom shield used to modulate or control microwave energy can be removed from the tray to enable or facilitate recycling.

The first and second foods may have different densities in addition to different weights and volumes. If desired, one or both quantities of food be in the form of pellets.

The upwardly convex bottom of the first integral compartment preferably includes a domed central portion and a lower, outer edge. Moreover, the domed central portion preferably has a maximum offset from the lower, outer edge in the range of about 0.1 inch to about 1.0 inch. This offset promotes more uniform heating of the associated food item by making the food item thinner in the middle and thicker at the edges.

A method of packaging multiple foods for microwave heating to different temperatures may include the steps of providing a microwavable tray having a smoothly contoured peripheral shape, multiple food receiving compartments laterally spaced from one another, where at least one food-receiving compartment includes an upwardly convex bottom surface. A first food is placed in a first food-receiving compartment of the tray such that the first food has a greater thickness at peripheral portions thereof than at central portions thereof, so that upon exposure to microwave energy for a predetermined time period the temperature of the first food reaches a corresponding first temperature. A second food is placed in a second food-receiving compartment of the tray. Then, a microwave modulating structure is applied to the tray so as to at least partially cover the second food-receiving compartment so that upon exposure to the microwave energy for a predetermined time period the temperature of the second food reaches a corresponding second temperature. The second temperature is different from the first temperature, and preferably can be less than the first temperature. At least the first food-receiving compartment is covered with a substantially microwave transparent structure, if desired. The method can also include the step of providing at least one of the first food and the second food in pelletized form. The microwave modulating structure reduces the microwave energy entering the second food-receiving compartment by at least about 25%.

BRIEF DESCRIPTION OF THE DRAWINGS:

Many objects and advantages of this invention will be apparent to those skilled in the art when this description is read in conjunction with the appended drawings wherein like reference numerals have been applied to like elements and wherein:

FIG. 21 is a perspective view of the yet another microwave tray having three compartments.

FIG. 22 is a plan view of the tray of FIG. 21.

DETAILED DESCRIPTION

Microwave heating trays often include adjacent compartments for heating more than one quantity of food at a time. Often, different foods in different compartments heat unevenly resulting in hot and cold spots within each quantity of food as a result of the varying density of the foods, water content, and other such factors. In addition, since all compartments are subjected to the same incident microwave energy, some food may be overheated when heated by microwave along with other foods. Moreover, many microwave ovens often include a glass tray that holds food off the floor of the microwave oven. However, not wishing to be bound by theory, the glass tray absorbs some heat or energy from the food, thereby potentially lengthening heating times and causing uneven heating of foods. Nevertheless, by elevating at least a portion of the food within a microwave oven above the bottom or floor of the oven, the food may heat faster and more evenly. Microwave energy in the oven is generally reflected from the internal surfaces of the oven, including the floor—so positioning the food away from the surface places the food at a location where the amplitude of the microwaves is higher than at a reflection point such as the internal surface.

The microwave heating tray of this disclosure includes at least a first integral compartment spaced from a second integral compartment by a land. The land thermally insulates the first integral compartment from the second integral compartment and contributes to substantially even heating of a first quantity of food and a second quantity of food. The first integral compartment is preferably defined by at least one sidewall and an upwardly convex bottom. That convex bottom functions to elevate at least a portion of the quantity of food contained in the first integral compartment above the floor of a microwave oven. Moreover, the associated food item is thinner in the central area above the convex bottom and thicker at the edges adjacent the compartment sidewall. This arrangement is helpful in providing a more uniform temperature for the associated food item. The second integral compartment may include microwave energy limiting structure operable to reduce and/or control exposure of the second quantity of food to microwave energy.

Figure 1:
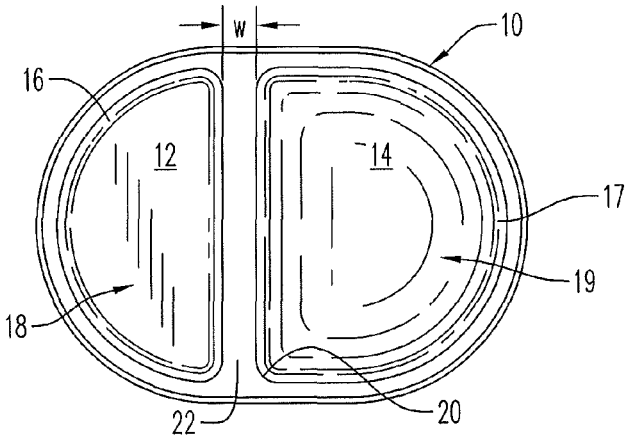
FIG. 1 is a top view of a first embodiment of a microwave heating tray.

As shown in FIG. 1, a microwave heating tray 10 includes a first integral compartment 14 and a second integral compartment 12. Each compartment is defined by at least one corresponding sidewall 16, 17 and a corresponding bottom 18, 19. Preferably, the compartments 12, 14 are separated by a land 22 so that the first integral compartment 14 is thermally isolated from the second integral compartment 12. The land 22 separates generally parallel portions of the adjacent to portions of sidewalls 16, 17.

Preferably, the microwave heating tray 10 has a smoothly contoured peripheral shape. By way of example, the smoothly contoured peripheral shape for the microwave heating tray 10 can be round, oval, or elliptical. Also preferably, the first integral compartment 14 and the second integral compartment 12 each have a smoothly contoured peripheral shape substantially free of sharp corners. Preferably, when the compartments 12, 14 include corners, the corners are rounded corners 20. Rounded corners of the compartments 12, 14 and the smoothly contoured peripheral shape of the microwave heating tray 10 and/or compartments 12, 14 help prevent overheating of food as compared to compartments and/or trays having sharp corners and/or non-rounded shapes. In addition, the rounded shape of the microwave heating tray 10 allows for easier molding of means for limiting microwave energy access, when used, around the quantity of food contained within the compartments 12, 14.

In the preferred embodiment, the first compartment 14 has a volume ranging from about 20 cubic inches to about 30 cubic inches and the second compartment 12 has a smaller volume ranging from about 12 cubic inches to about 18 cubic inches. For example, the first compartment 14 can have a volume of about 25 cubic inches and the second compartment 12 can have a volume of about 16 cubic inches. Also preferably, the first and second compartments 12, 14 can be about 1 inch to about 1.5 inch deep. However, the first compartment 14, having the upwardly concave bottom will have varying depths throughout the compartment. Also preferably, the first compartment 14 has a width ranging from about 4 inches to about 6 inches, more preferably about 4 inches to about 5 inches. Moreover, the second compartment 12 has a width ranging from about 3 inches to about 4 inches. Both the first compartment and the second compartment 12, 14 have a length ranging from about 5 inches to about 6 inches. Preferably, the length of the first and second compartments 12, 14 at the longest portion thereof is about the same as the length of the land 22.

In the preferred embodiment, the microwave heating tray 10 may be formed of a conventional microwave-safe material, such as heat resistant plastic, that is not subject to scorching, burning, melting, deformation, and the like when exposed to microwave heating energy. The material used to form the microwave heating tray must also be safe for use with foods. Preferred microwave safe materials can be selected from the group consisting of polyethylene terephthalate (PET), crystalline polyethylene terephthalate (CPET), polypropylene, high-heat styrenic copolymers such as DYLARK®, mineral filled polypropylene, molded pulp, pressed paper, high density polyethylene (HDPE), and/or combinations thereof. Moreover, the material used to form the microwave heating tray 10 is thick enough to form a substantially rigid tray.

Also in the preferred embodiment, the first integral compartment 14 is spaced from and connected to the second integral compartment by the land 22. The land 22 has a width w (also shown in FIG. 2) ranging from about 0.125 inch to about 0.75 inch, more preferably about 0.4 inch to about 0.6 inch. Preferably, the land 22 has a uniform width across the length thereof. By spacing apart the first integral compartment 14 from the second integral compartment 12, the compartments 12, 14 are thermally insulated from one another so that different heating temperatures can be achieved in each compartment 12, 14 if desired. Compartments 12, 14 that are positioned too closely do not sufficiently insulate the first quantity of food in the first integral compartment 14 from the second quantity of food in the second compartment 12 which can result in one or more quantities of foods that are at least partially overheated and/or under heated.

Figure 2:
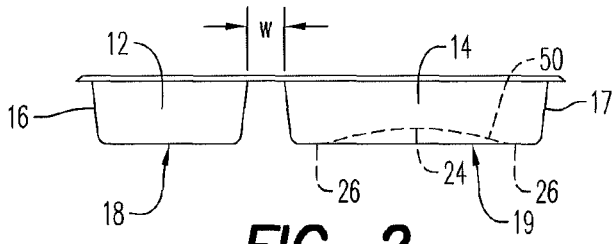
FIG. 2 is a side view of an embodiment of a microwave heating tray.

As shown in FIG. 2, the first integral compartment 14 includes at least one sidewall 17 and an upwardly convex bottom 19 defined by a dome sidewall 50. The upwardly convex bottom 19 includes a domed central portion 24 surrounded by a lower, outer edge 26. Preferably, the domed central portion 24 is located substantially in the center of the first integral compartment 14 because food located in the center typically heats up more slowly than food on the outer periphery. Thus, by locating the domed central portion 24 centrally, the portion of the quantity of food in the center of the compartment 14 will be thinner and will heat faster so that the food in the center and the food located at the edge reaches about the same temperature at about the same time. In addition, the domed central portion 24 elevates the food above the glass bottom of the microwave oven so as to prevent heat energy transfer to the glass. Warm air trapped underneath the domed central portion 24 during heating also insulates the food from the glass thereby preventing loss of heat and allowing for faster heating of the food located in the center of the first integral compartment 14.

Also in the preferred embodiment, the food located at the edges of first compartment 14 is thinner than the food located at the domed central portion 24. Preferably, the thickness of the food at the edges of the first compartment 14 ranges from about 0.5 inch to about 0.875 inch, and the thickness of the food at the center of the first compartment 14 ranges from about 0.312 inch to about 0.5 inch when the dome has a height of about 0.3 inch. When the dome has a height of about 0.13 inch, the thickness of the food at the edges ranges from about 0.438 inch to about 0.938 inch and the food at the center of the first compartment 14 ranges from about 0.312 inch to 0.813 inch. When the dome has a height of about 0.47 inch, the thickness of the food at the edges ranges from about 0.625 inch to about 1.06 inch and the food at the center of the first compartment 14 ranges from about 0.312 inch to 0.625 inch.

Figure 3:
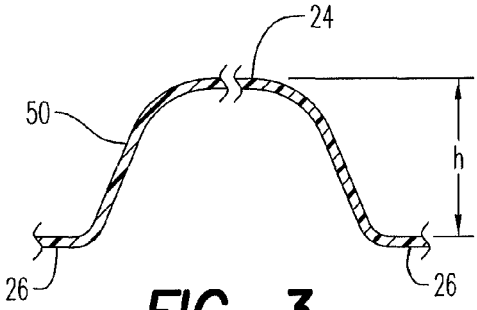
FIG. 3 is an enlarged partial cross-sectional view of a first embodiment of a domed convex bottom.
Figure 4:
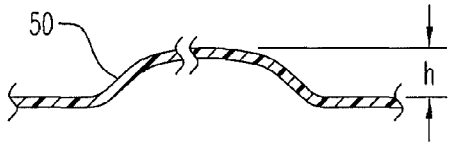
FIG. 4 is an enlarged partial cross-sectional view of a second embodiment of a domed convex bottom.

In the preferred embodiment, the domed central portion 24 of the first integral compartment 14 can have a height of about 0.1 inch to about 1.0 inch, more preferably about 0.15 inch to about 0.75 inch, and most preferably about 0.2 inch to about 0.6 inch. As shown in FIG. 3, for example, the domed central portion 24 can have a height of about 0.47 inch and have a steep dome sidewall 50. Alternatively, as shown in FIG. 4, for example, the domed central portion 24 can have a height of about 0.13 inch and can have gently sloped dome sidewall 50. Dome heights that are too small or too large can deter even heating throughout the first integral compartment 14 as described in greater detail below.

Figure 5:
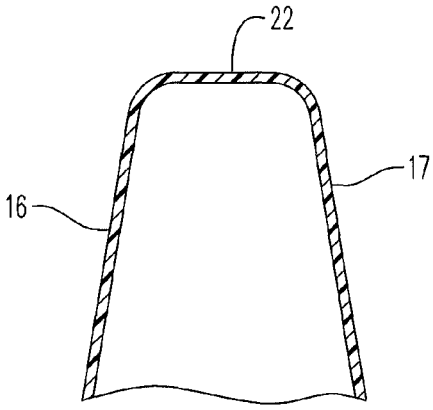
FIG. 5 is an enlarged partial cross-sectional view of a second embodiment of a land and sidewalls of the microwave heating tray.
Figure 6:
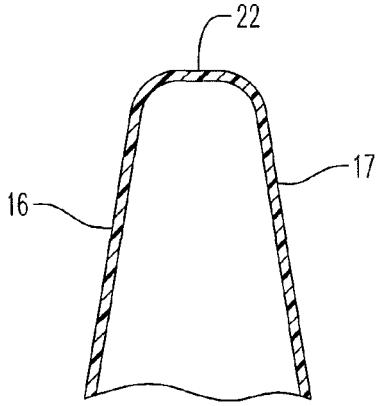
FIG. 6 is an enlarged partial cross-sectional view of a third embodiment of a land and sidewalls of the microwave heating tray.

In the preferred embodiment, as shown in FIG. 2 (and also in FIG. 5 and FIG. 6), adjacent portions of the sidewalls 16, 17 of the first integral compartment 14 and the second integral compartment 12 diverge in a downward direction. Alternatively, the adjacent portions of the sidewalls 16, 17 can be substantially parallel. The diverging sidewalls allow for efficient stacking and denesting of the trays during manufacture of the trays and filling of the trays. In contrast, substantially vertical sidewalls deter efficient stacking of the trays.

Figure 7:
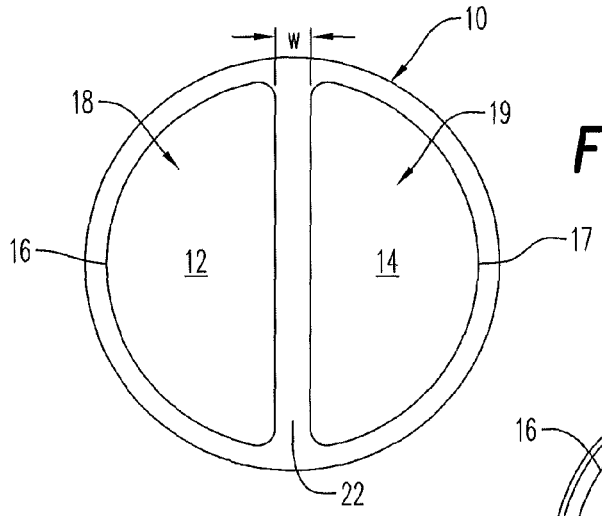
FIG. 7 is a top view of a round microwave heating tray.

As shown of FIG. 7, in the embodiment, the microwave heating tray 10 can be round in external shape and can include a first integral compartment 14 and a second integral compartment 12 separated by a chord or diameter of the round shape. The first integral compartment 14 is defined by at least one sidewall 17 and a bottom 19. In the preferred embodiment, the bottom 19 is an upwardly convex bottom operable to elevate at least a portion of a quantity of food above the floor of a microwave oven during heating. The second integral compartment 12 is defined by at least one sidewall 16 and a bottom 18. The first integral compartment 14 is spaced from the second integral compartment 12 by a land 22, which has a width w sufficient to thermally insulate the first integral compartment 14 from the second integral compartment 12 so that a preferred temperatures may be reached in each compartment 12, 14.

Figure 8:
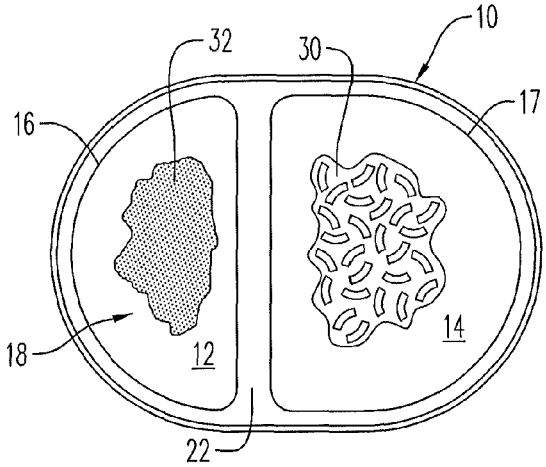
FIG. 8 is a top view of the microwave heating tray of FIG. 1 including a first quantity of food and a second quantity of food.

As shown in FIG. 8, the first integral compartment 14 can contain a first quantity of a first food 30 and the second integral compartment 12 can contain a second quantity of a second food 32. In the preferred embodiment, the first quantity of food 30 and the second quantity of food 32 are different types and/or quantities of foods. In another embodiment, the first quantity of food 30 and the second quantity of food 32 are the same type and/or quantity of food. For example, the first quantity of food 30 can be macaroni-and-cheese and the second quantity of food 32 can be applesauce.

Preferably, the first quantity of food 30 heats more slowly than the second quantity of food 32. Also preferably, the first and second quantities of food 30, 32 have different densities so that the foods will both heat to a desirable temperature in about the same length of time and so that the available food types can be expanded in comparison to previously available combinations. Thus, the first quantity of food 30 may have a lower density and may heat faster. In the preferred embodiment, the first quantity of food 30 can also be pelletized to lower the density thereof. In other embodiments, the first quantity of food 30 can be formed into cubes or a toroidal configuration so as to reduce the heating time needed to substantially uniformly heat the first quantity of food 30. In an alternative embodiment, the second quantity of food 32 can have a lower density than the first quantity of food 30.

For purposes of this disclosure, a "pellet" is intended to mean a small piece of a food ingredient. That pellet may be any regular or irregular shape including, for example and without limitation, generally spherical, generally circular disk, generally hemispherical, generally cubic, generally cylindrical, generally toroidal, generally planar, and the like. Moreover, the pellet preferably has a principal dimension which is substantially smaller than the maximum lateral dimension of an associated tray compartment, for example, less than about 25% of such maximum lateral dimension. Alternatively, the pellet preferably has a principal dimension which is smaller than the depth of an associated tray compartment. For purposes of this disclosure, the term "pelletized" means forming an ingredient into pellets.

Also in the preferred embodiment, the ratio of the weight of the first quantity of food 30 to the weight of the second quantity of food 32 can be adjusted to regulate or control the final temperature of the quantity of food 30, 32 based on heating time. For example, when macaroni-and-cheese is placed in the first compartment 14 and applesauce is placed in the second compartment 12, the weight of the macaroni-and-cheese is about 7.5 ounces and the weight of the applesauce is about 4.5 ounces. Thus, the ratio of macaroni-and-cheese to applesauce is about 62.5% to about 37.5% or about 5:3. When chili and cornbread are placed in the first compartment 14 and the second compartment 12, respectively, the chili weighs about 7.5 ounces and the cornbread weighs about 2.5 ounces. Thus, the ratio of chili to cornbread is about 75% to about 25% or about 3:1.

The first quantity of food 30 and the second quantity of food 32 can be selected from the group consisting of bread products, soups, vegetables, meats, sandwiches, pizzas, sauces, dips, condiments, desserts, pastas, wraps, casserole type dishes, appetizers, such as chicken wings, nachos, egg rolls, and mozzarella sticks, seafood, rice, beans, yogurt, cottage cheese, ice cream, custard, fruit, salad, and/or combinations thereof.

Figure 9:
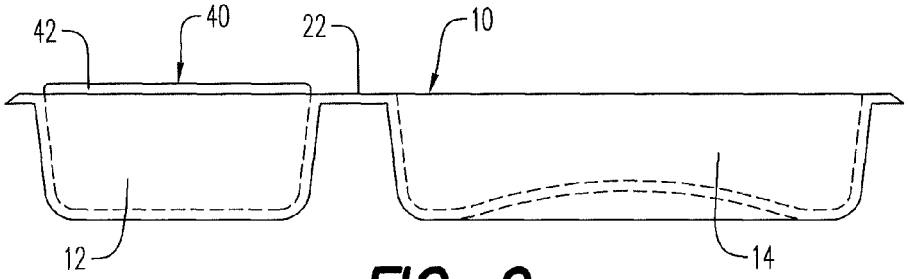
FIG. 9 is a side view of an embodiment of a microwave heating tray including microwave energy limiting structure.
Figure 10:
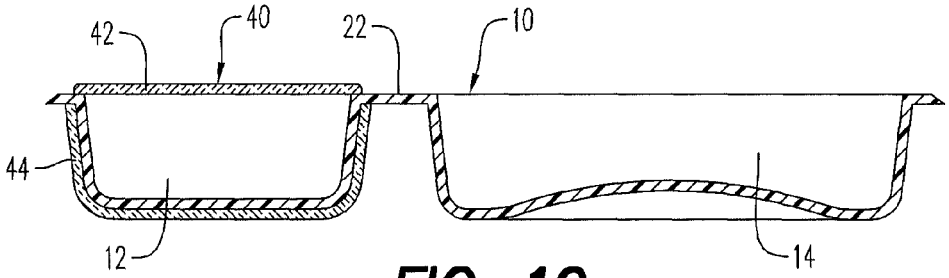
FIG. 10 is a cross-sectional view of a second embodiment of a microwave heating tray including microwave energy limiting structure.

As shown in FIGS. 9 and 10, in the preferred embodiment, the microwave heating tray 10 may include means for limiting microwave energy access. The means for limiting microwave energy access 40 can be in the form of a top shield 42 that at least partially blocks microwave energy from entering through a top of the second compartment 12 so as to reduce the heated temperature. In the preferred embodiment, the top shield 42 is flat material and may be incorporated in a film material which can also act as a lid. In further embodiment, the means for limiting microwave energy access 40 can be formed as a single piece. In another embodiment, the means for limiting microwave energy access 40 can be in multiple pieces. Larger means for limiting microwave energy access tend to result in a lower temperature of food. Thus, when a lower food temperature is desired, it is preferred that larger means for limiting microwave energy access be used.

As shown in FIG. 10, the means for limiting microwave energy access 40 of second integral compartment 12 of the microwave heating tray 10 can include a bottom shield 44 in addition to the top shield 42. In the preferred embodiment, the bottom shield 44 is formed so as to at least partially cover the sidewalls and bottom of the compartment over which the bottom shield 44 is applied.

In the preferred embodiment, it can be important to maintain a distance of at least about 2 mm between the top shield 42 and bottom shield 44 so as to prevent arcing in the microwave oven. If the closest distance between the two shields is less than about 2 mm, a large electric potential may be created which could cause arcing.

In another embodiment, the means for limiting microwave energy access 40 does not include any holes, slits, and the like therein. In still another embodiments, the means for limiting microwave energy access 40 can include holes, slits, and the like therein. When used, the size and/or shape of the holes in the top shield 42 and/or bottom shield 44 can be modified to optimize heating of the quantity of food contained in the compartment being shielded. For example, the holes in the top and/or bottom shield can be shaped as circles, squares, rectangles, pentagons, triangles, quadrilaterals, elongate slots, and combinations thereof. Additionally, the holes in the bottom shield 44 and/or top shield 42 can vary in location and size in order to control the amount of microwave energy entering the compartment so as to further optimize temperature and heating time. Thus, the shape of the holes and/or slots can be chosen to optimize heating. In the preferred embodiment, the holes may be circular holes which provide a consistent diameter throughout the means for limiting microwave energy access 40. As compared to rectangular holes, circular holes have a more easily controlled size when multiple holes are placed in the means for limiting microwave energy access 40. The placement of the holes may be selected as a function of where and how microwave energy should be focused within the shielded compartment. Preferably, the diameter of the hole is at least about 2 mm to prevent arcing in the microwave.

In the preferred embodiment, the means for limiting microwave energy access 40 may be removable from the microwave heating tray 10. For example, a microwave tray 10 can include a top shield 42 and a bottom shield 44 as shown in FIG. 10. Both the top shield 42 and the bottom shield 44 can be removable from the microwave tray 10 so the separate components may be recycled. When the bottom shield 44 is removable, the bottom shield 44 and the compartment can include a snap feature to secure the bottom shield 44 to the bottom of the compartment. Alternatively, the bottom shield 44 may be permanently attached to the tray. In yet another embodiment, the bottom shield may be semi-permanently affixed to the microwave tray 10 by a microwave safe adhesive.

Also in the preferred embodiment, the means for limiting microwave energy access includes a material selected from the group consisting of foil, microwave absorbing material, microwave transmitting material, microwave reflecting material, and combinations thereof. In the preferred embodiment, the foil is aluminum foil. Preferably, when using a foil shield, the foil is not laminated to a polymeric material. Also preferably, the means for limiting microwave energy access is a passive microwave shield that does not include microwave energy interactive elements.

In the preferred embodiment, the means for limiting microwave energy access reduces the microwave energy entering the second integral compartment by at least about 25%. To determine the amount of microwave energy absorbed in each compartment, the following energy equation was used:

$$E=C_p*m*\Delta T/t$$

where E is the energy in J/sec; $C_p$ is the specific heat of water at constant pressure (4.187 J/g ° C.); m is the mass in grams; ΔT is the final temperature minus the initial temperature in ° C.; and t is the time in seconds. The amount of microwave energy can then be used to determine the percentage of microwave energy penetrating into each compartment. The two compartment tray was filled with various weights in each compartment to simulate variability in the energy equation. The initial temperature of both compartments was taken before the shielding structure was placed over the second compartment. After heating, the temperature of each compartment was taken to find out the energy present in each compartment. Ten tests with each shielding structure were performed to determine if the energy present in each compartment was similar.

Table 1 shows the percent energy in each compartment and the energy difference between the compartments when macaroni-and-cheese is placed in the first compartment and applesauce is placed in the second compartment.

TABLE 1

Macaroni & Cheese with Applesauce Shielding Tray

| Sample | Energy in Tray (Watts) | % Energy in Large | % Energy in Small | % Energy Difference |
|---|---|---|---|---|
| 1 | 843.437 | 69.71 | 30.29 | 39.41 |
| 2 | 896.850 | 75.40 | 24.60 | 50.80 |
| 3 | 811.174 | 73.55 | 26.45 | 47.10 |
| 4 | 760.284 | 73.54 | 26.46 | 47.08 |
| 5 | 784.962 | 71.58 | 28.42 | 43.16 |
| 6 | 782.220 | 74.28 | 25.72 | 48.56 |
| 7 | 893.713 | 70.03 | 29.97 | 40.06 |
| 8 | 860.774 | 79.87 | 20.13 | 59.75 |
| 9 | 773.266 | 72.30 | 27.70 | 44.61 |
| 10 | 794.953 | 75.51 | 24.49 | 51.02 |
| Average | 820.17 | 73.58 | 26.42 | 47.15 |
| Std. Dev. | 50.18 | 2.99% | 2.99% | 5.98% |
| COV | 6.12 | 7.28 | 12.91 | |

As shown, about 73% of the energy in the tray is received in the first compartment, while about 27% of the energy in the tray is received in the second compartment. Thus, the small shielded compartment receives about 27% of the microwave energy in the tray during heating.

Table 2 shows the percent energy in each compartment and the energy difference between the compartments when chili is placed in the first compartment and cornbread is placed in the second compartment.

TABLE 2

Chili & Cornbread Shielding Tray

| Sample | Energy in Tray (Watts) | % Energy in Large | % Energy in Small | % Energy Difference |
|---|---|---|---|---|
| 1 | 635.622 | 94.81 | 5.19 | 89.62 |
| 2 | 648.480 | 93.76 | 6.24 | 87.53 |
| 3 | 597.087 | 93.87 | 6.13 | 87.74 |
| 4 | 746.620 | 93.84 | 6.16 | 87.68 |
| 5 | 534.903 | 90.50 | 9.50 | 81.00 |
| 6 | 527.862 | 92.22 | 7.78 | 84.45 |
| 7 | 714.041 | 93.96 | 6.04 | 87.92 |
| 8 | 673.526 | 93.85 | 6.15 | 87.70 |
| 9 | 684.140 | 92.17 | 7.83 | 84.33 |
| 10 | 624.453 | 94.10 | 5.90 | 88.19 |
| Average | 638.674 | 93.31 | 6.69 | 86.62 |
| Std. Dev. | 71.26 | 1.28% | 1.28% | 2.56% |
| COV | 11.16 | 11.86 | 15.14 | |

As shown, about 93% of the energy in the tray is received in the first compartment, while about 7% of the energy in the tray is received in the second compartment. Thus, the small shielded compartment receives about 7% of the microwave energy in the tray during heating.

When comparing the results from Table 1 and Table 2, it can be concluded that changing the mass of water in each compartment and/or adjusting the cooking were not significant factors within the energy equation due to the small standard deviations and coefficient of variation (COV) values.

In use, the combination of the means for limiting microwave energy access, the upwardly convex bottom of the first integral compartment and the land separating the first and second integral compartments act together to shield, separate and evenly distribute heat throughout the quantities of food contained in each compartment. The means for limiting microwave energy access at least partially prevents microwave energy from reaching the quantity of food so as to avoid overheating or maintain a cooler temperature as compared to an unshielded quantity of food. The separation between the compartments acts to thermally insulate each compartment from the other so as to allow for different heating temperatures in each compartment. Finally, the upwardly convex bottom in the first integral compartment causes food in the center of the compartment to heat more quickly so that the food in the first integral compartment is heated substantially uniformly throughout.

A method for packaging multiple foods for microwave heating to different temperatures includes providing a microwave tray having a smoothly contoured shape and at least a first integral compartment and a second integral compartment separated by a land as described above. The first integral compartment is defined by at least one sidewall and an upwardly convex bottom and the second integral compartment is defined by at least one sidewall and a bottom. A first food is placed in the first integral compartment of the tray such that the first food has a greater thickness at peripheral portions thereof than at central portions thereof. Thus, upon exposure to microwave energy the temperature of the first food is substantially even throughout the first food. A second food is placed in the second integral compartment, and may be at least partially covered with a means for limiting microwave energy access. Upon exposure to microwave energy, the second food reaches a lower temperature than the first food due to the use of the means for limiting microwave energy access. The first integral compartment can be covered with a lid, such as a film. Preferably, the means for limiting microwave energy access reduces the microwave energy entering the second integral compartment by at least about 25%. In a preferred embodiment, the first and/or second food can be pelletized to lower the density thereof.

To determine the effect of the height of the domed central portion of the first integral compartment on the heating profile within the compartment, an equal quantity of macaroni-and-cheese was placed in the first integral compartment of each of three containers and heated for about 200 seconds in a 1200 Watt microwave oven. Each container was formed of black DYLARK® material and included the same shielding material and shielding configuration. During testing, each container was placed in the same orientation and location within the microwave. The first container had a domed central portion having a height of about 0.125 inch, the second container had a domed central portion having a height of about 0.3 inch, and the third container had a domed central portion having a height of about 0.438 inch. After heating, the temperature of the macaroni-and-cheese was tested in the center and along the periphery. The average center macaroni-and-cheese temperature was lower and had a greater difference between the temperature at the periphery and the center of the compartment in the first and third containers as compared to the second container. Thus, it appears that containers having a domed central portion height of about 0.3 inch provide more even cooking as compared to containers with smaller or larger heights.

To determine the effect of the land width on the temperature attained in the first integral compartment and the second integral compartment, an equal quantity of macaroni-and-cheese was placed in the first integral compartment and an equal quantity of applesauce was place in each of the second integral compartments of each of three containers and heated for about 200 seconds in a 1200 Watt microwave oven. Each container was formed of black DYLARK® material and included the same shielding material and shielding configuration. The first container had a land width of about 0.25 inch, the second container had a land width of about 0.375 inch, and the third container had a land width of about 0.5 inch.

Figure 11:
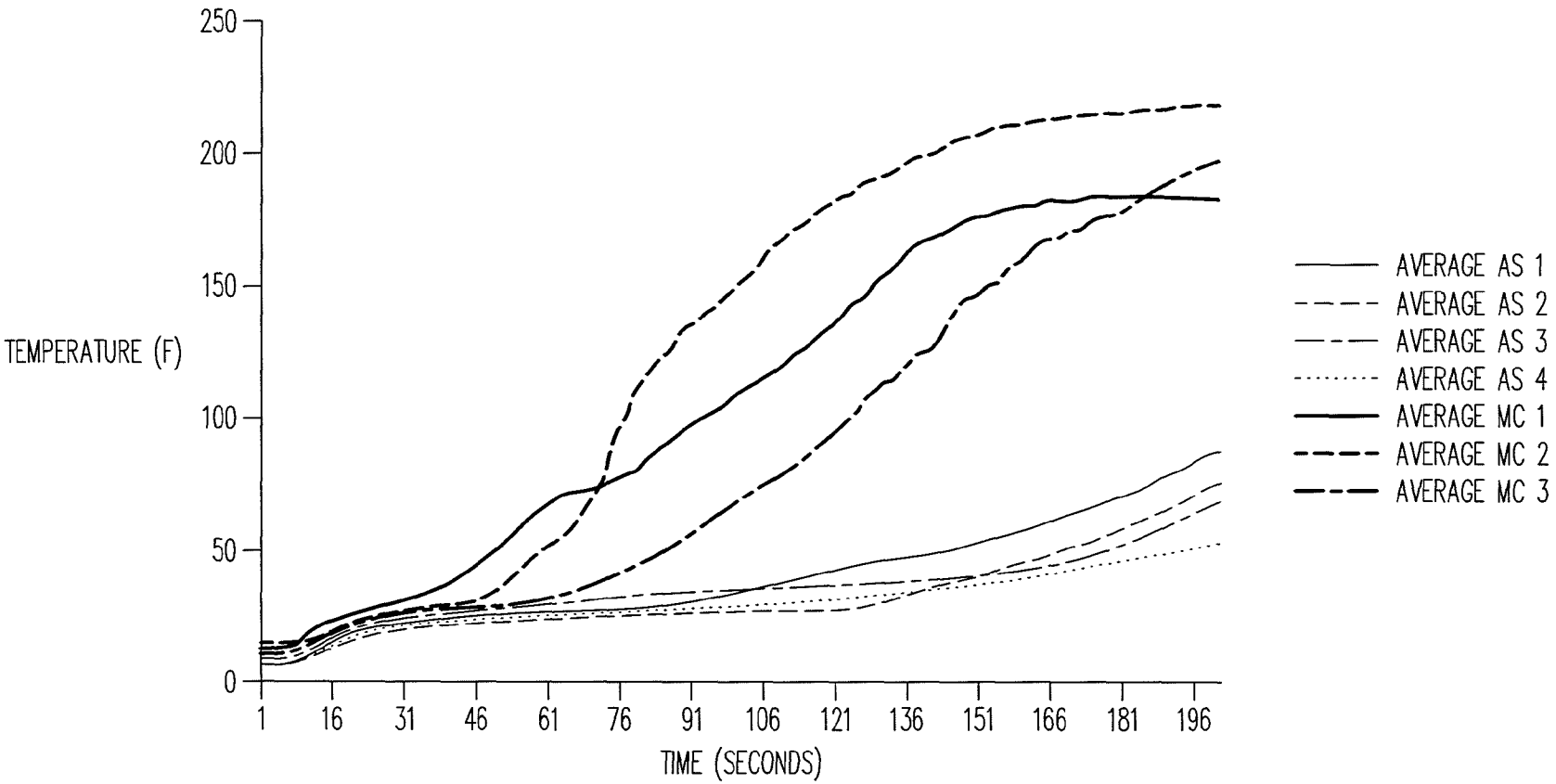
FIG. 11 is a graph showing the temperature as a function of time of macaroni-and-cheese and applesauce heated in separate compartments of the same container having a 0.25 inch land area.

FIG. 11 shows the average temperature as a function of time for the applesauce as well as the macaroni-and-cheese at various locations in the first integral compartment and the second integral compartment of a container having a 0.25 inch land width. The applesauce temperature was measured at four locations within the second integral compartment and the temperature at each of the four locations after about 200 seconds of heating ranged from about 50° F. to about 90° F. The macaroni-and-cheese in the first integral compartment was measured at three locations. After about 200 seconds of heating, the macaroni-and-cheese ranged in temperature from about 180° F. to about 220° F.

Figure 12:
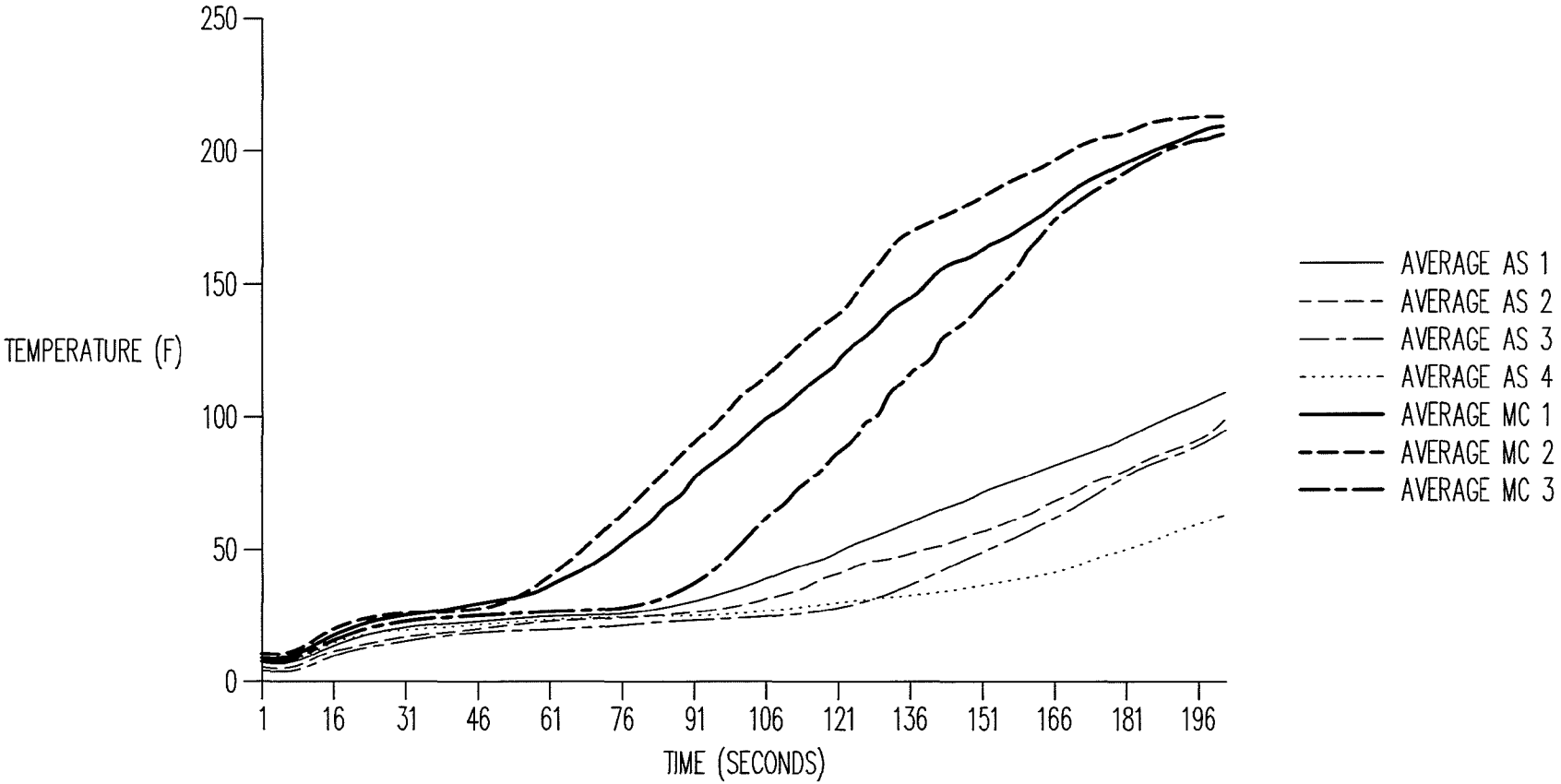
FIG. 12 is a graph showing the temperature as a function of time of macaroni-and-cheese and applesauce heated in separate compartments of the same container having a 0.375 inch land area.

FIG. 12 shows the average temperature as a function of time for the applesauce and macaroni-and-cheese at various locations in the first integral compartment and the second integral compartment of a container having a 0.375 inch land width. The applesauce temperature was measured at four locations within the second integral tray and the temperature at each of the four locations after about 200 seconds of heating ranged from about 60° F. to about 110° F. The macaroni-and-cheese in the first integral compartment was measured at three locations. After about 200 seconds of heating, the macaroni-and-cheese ranged in temperature from about 210° F. to about 215° F.

Figure 13:
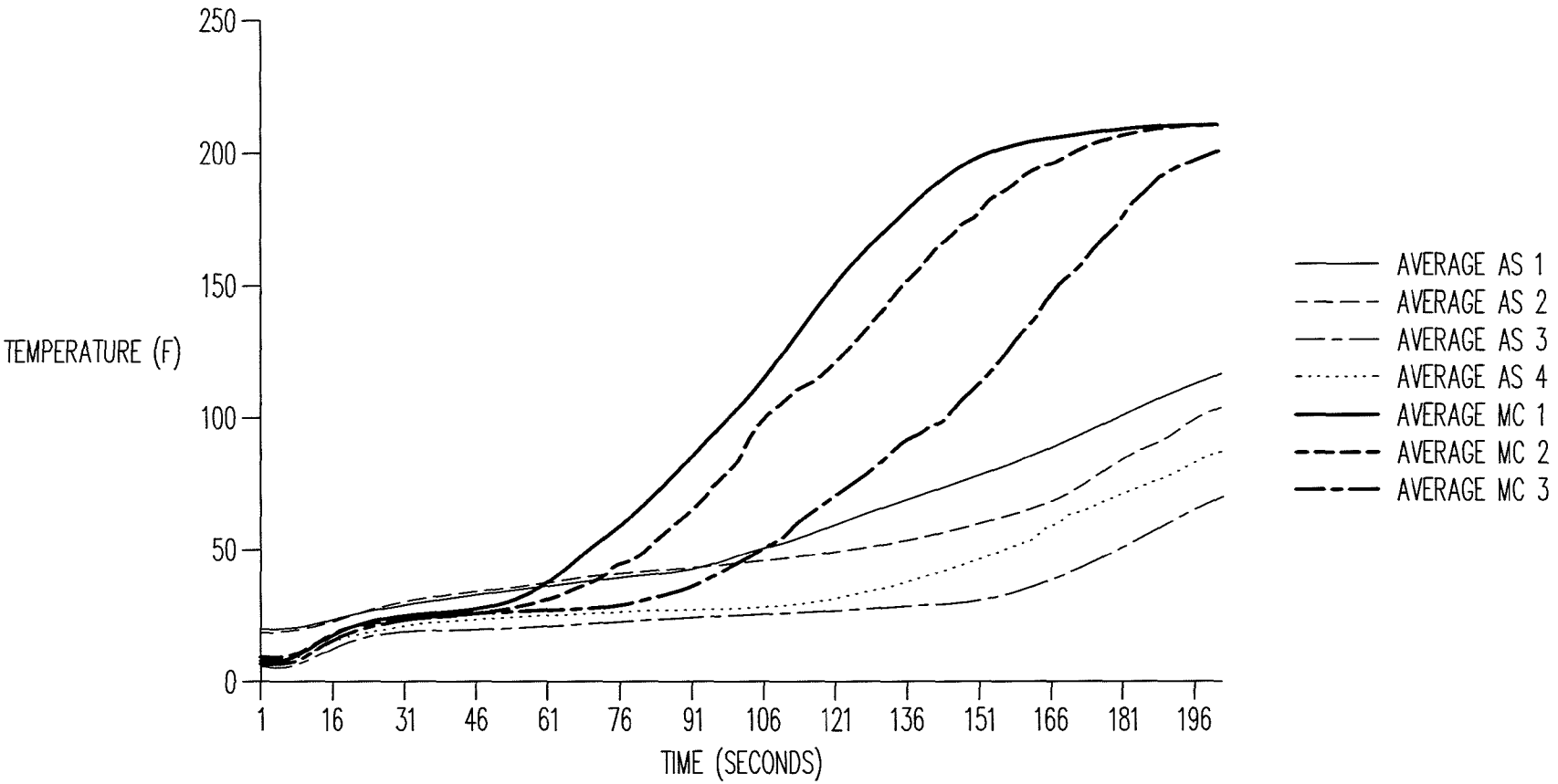
FIG. 13 is a graph showing the temperature as a function of time of macaroni-and-cheese and applesauce heated in separate compartments of the same container having a 0.5 inch land area.

FIG. 13 shows the average temperature as a function of time for the applesauce and macaroni-and-cheese at various locations in the first integral compartment and the second integral compartment of a container having a 0.5 inch land width. The applesauce temperature was measured at four locations within the second integral tray and the temperature at each of the four locations after about 200 seconds of heating ranged from about 65° F. to about 120° F. The macaroni-and-cheese in the first integral compartment was measured at three locations. After about 200 seconds of heating, the macaroni-and-cheese ranged in temperature from about 205° F. to about 215° F.

To determine the effect of lands having a width greater than about 0.5 inch, a first integral compartment containing macaroni-and-cheese and a second integral compartment containing applesauce was separated by about 3 inches in a microwave oven and heated from about 200 seconds. Each container was formed of black DYLARK® material and included the same shielding material and shielding configuration. Wider lands are preferred to help insulate and isolate food in the first integral compartment from food in the second integral compartment.

Figure 14:
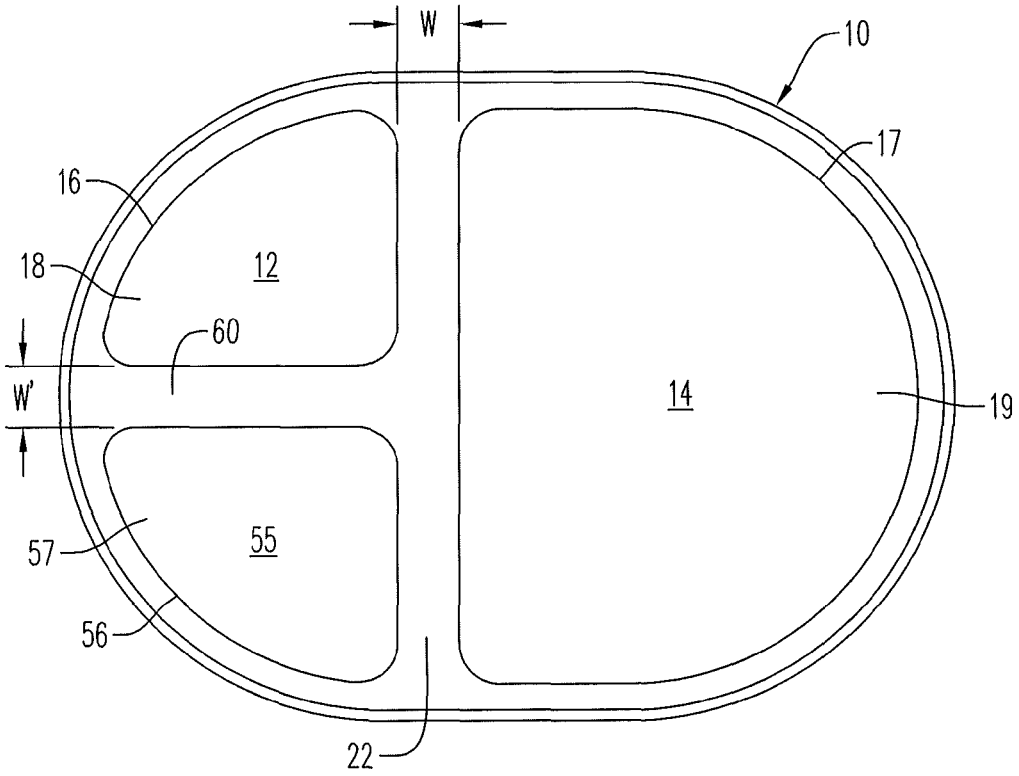
FIG. 14 is a top view of a microwave tray including three compartments.

In another embodiment, as shown in FIG. 14, a microwave heating tray 10 includes a first integral compartment 14, a second integral compartment 12, and a third integral compartment 55. Each compartment is defined by at least one corresponding sidewall 17, 16, 56 and a corresponding bottom 19, 18, 57.

Preferably, the first compartment 14 is separated from the second and third compartments 12, 55 by a land 22 so that the first integral compartment 14 is thermally isolated from the first and second integral compartments 12, 55. Also preferably, the second compartment 12 is separated from the third compartment 55 by a second land 60. Preferably, the second land has a width w' that is sufficient to thermally isolate the second compartment 12 from the third compartment 55.

Preferably, the width w' of the second land 60 and the width w of the first land 22 range from about 0.125 inch to about 0.75 inch, more preferably about 0.4 inch to about 0.6 inch. Preferably, the land 22 has a uniform transverse width substantially throughout the length thereof. In addition to the land characteristics, the seal between the lidding material and the tray is also important to maintenance of different temperatures in different compartments. To this end, it should be noted that when lidding material is applied to the tray, after the tray compartments have been filled with edible products, the lid is sealed to the tray not only around the peripheral edge but also along the lands between adjacent compartments 12, 14, 55. Preferably, that sealing operation isolates each compartment 12, 14, 55 from each of the other compartments 12, 14, 55.

Also preferably, each of the first, second, and third compartments 12, 14, 55 may contain a different food. In an alternative embodiment, second, and third compartments 12, 14, 55 can contain the same food. Preferably, the foods contained in the first, second, and third compartments 12, 14, 55 have different densities and/or heating characteristics (e.g., dielectric and thermal properties).

Figure 15:
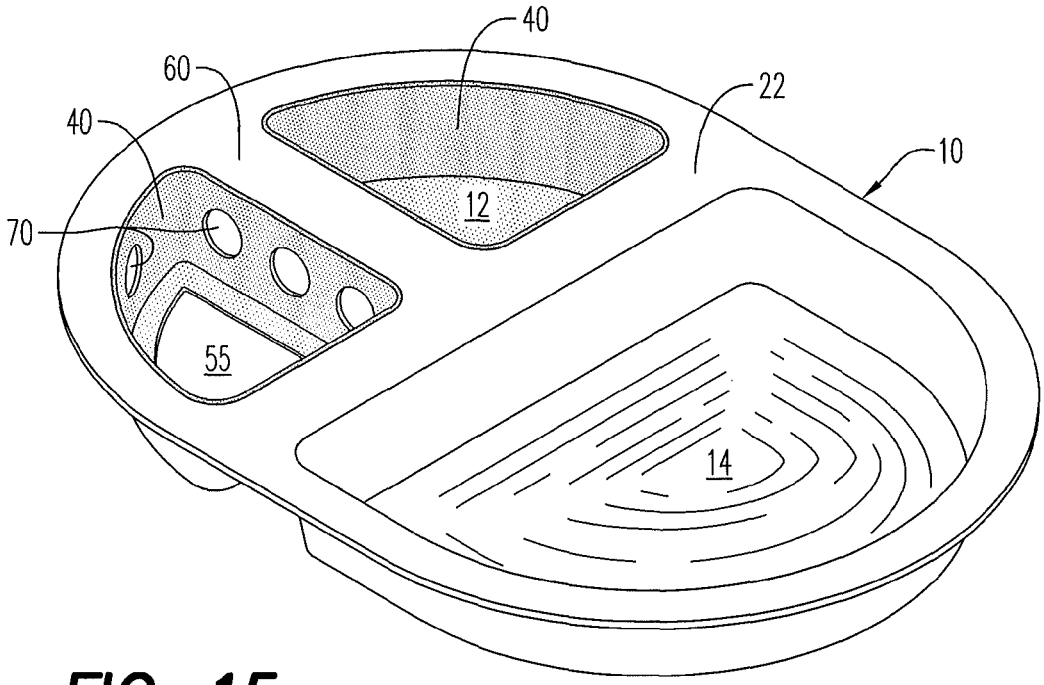
FIG. 15 is a perspective view of a microwave tray including three compartments and microwave energy limiting structure.

As shown in FIG. 15, the second compartment 12 and the third compartment 55 can include menas 40 for limiting microwave energy access to the second integral compartment 12 and to the third integral compartment of the microwave heating tray 10. In the preferred embodiment, the second and third compartments 12, 55 have different amounts of coverage of the means for limiting microwave access. For example, as shown in FIG. 15, the means for limiting microwave energy access 40 within the second compartment 12 does not include holes therein, while the means for limiting microwave energy access 40 within the third compartment 55 does include holes 70 so as to allow more microwave energy to enter the third compartment 55 than the second compartment 12. Moreover, the means for limiting microwave energy access 40 within the third compartment 55 can cover only the sides and a portion of the bottom of the compartment, while the second compartment 12 can include means for limiting microwave energy access 40 on the sidewalls and bottom thereof. Thus, more microwave energy is able to enter the third compartment 55 than the second compartment 12. In the preferred embodiment, the means for limiting microwave energy access 40 is located on an inner surface of the second and third compartments 12, 55. In an alternative embodiment, the means for limiting microwave energy access 40 is located on an exterior surface of the compartment as shown in FIG. 10. In an alternative embodiment, the second and third compartments 12, 55 include the same amount of coverage of means for limiting microwave energy access.

The particular location and amount of shielding used for any particular combination of foods will depend on the desired temperature for each food of the combination. Accordingly, it is within the scope of this invention, for example and without limitation, that only one compartment is shielded, that all compartments are shielded, that the amount of shielding is different for each of the compartments, that the amount of shielding is the same for two or more compartments, and the like.

Figure 16:
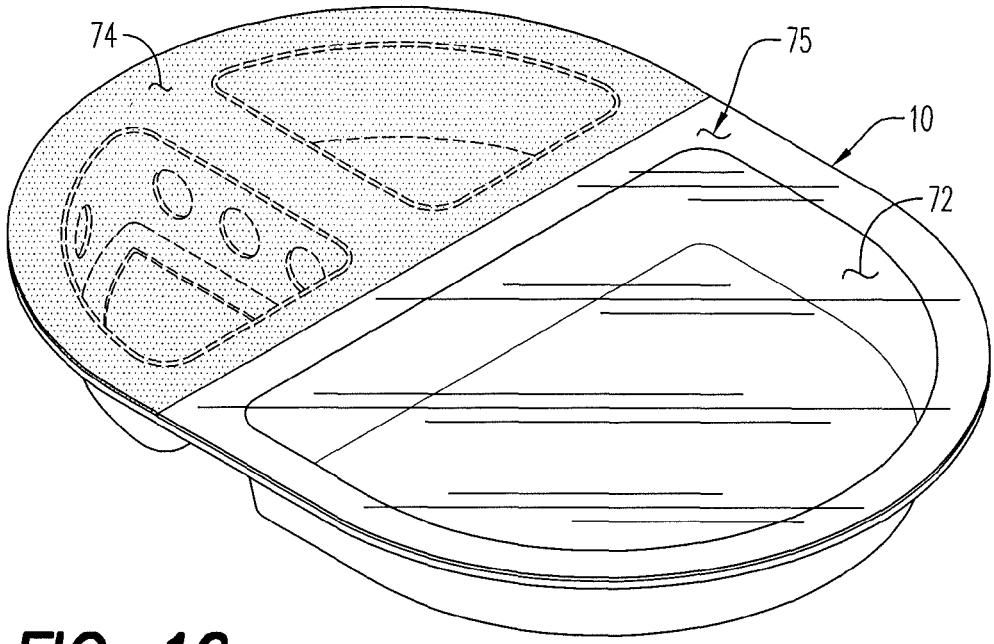
FIG. 16 is a perspective view of a microwave tray including three compartments and a lid.

As shown in FIG. 16, the microwave heating tray 10 can also include a removable lid 75. The portion of the lid 74, which covers the second and third compartments, can be formed of the material used to form the means for limited microwave energy access. In addition, the portion of the lid 72 used to cover the first compartment can be formed of a clear plastic material. Thus, the lid 75 can be formed to at least partially prevent microwave energy from entering one or more compartments of the tray 10. In other embodiments, the lid 74 can be formed entirely of the material used to form the means for limited microwave energy access or of a clear plastic film depending upon the amount of microwave energy desired to enter each compartment. It is to be understood, that the lid material may be constructed and arranged such that the shielding aspects of the material have holes and/or slits as described above, while the lid material itself is continuous. For example, where the lid material is a composite of two or more layers, one layer may be continuous while a second layer containing microwave shielding material may have holes and/or slots for energy control.

Figure 17:
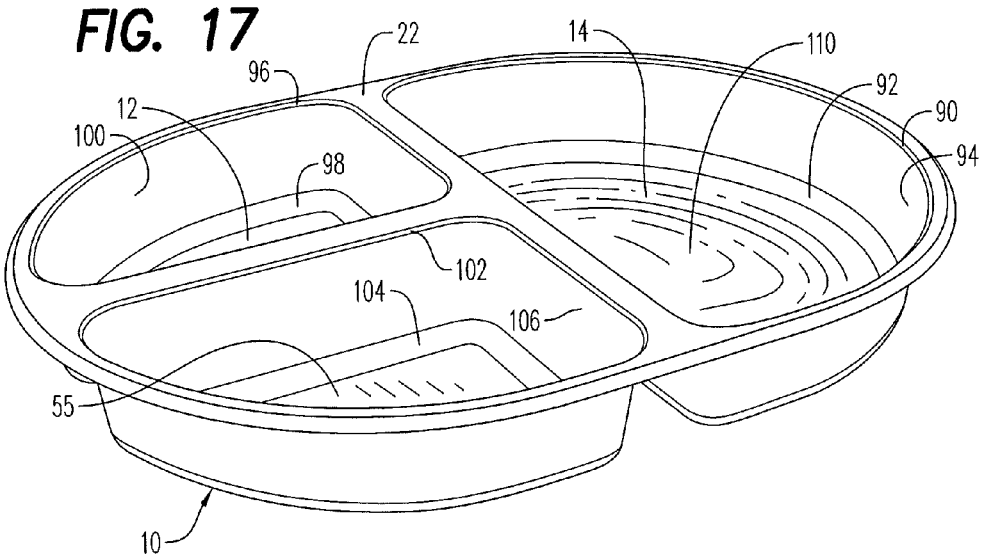
FIG. 17 is a perspective view of another microwave tray with three compartments.
Figure 18:
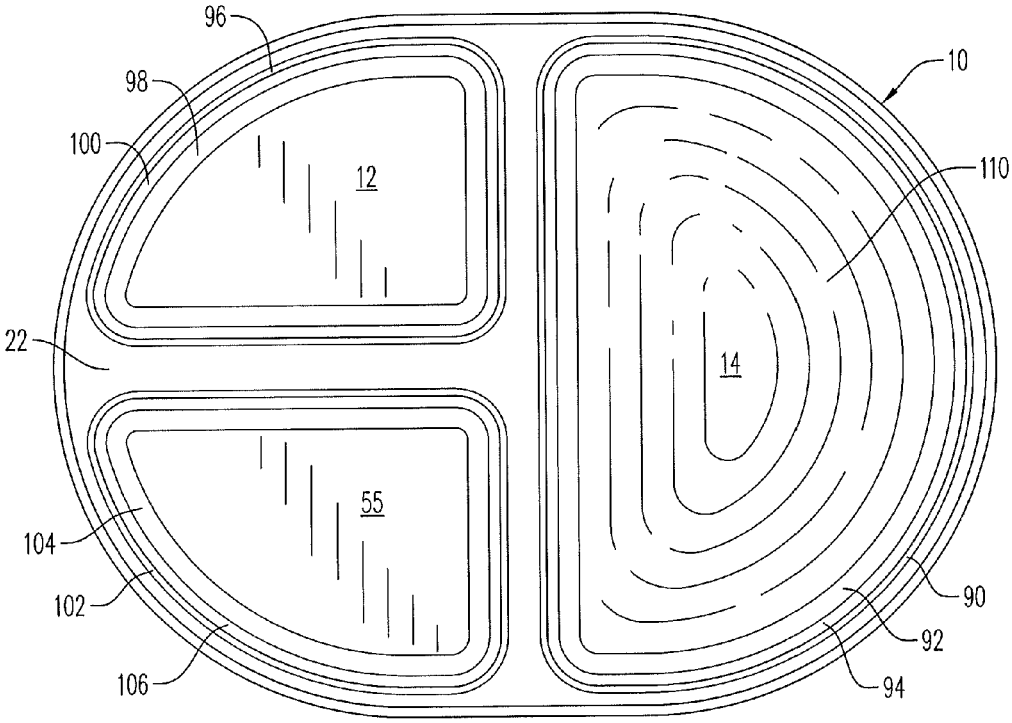
FIG. 18 is a plan view of the microwave tray of FIG. 17.

Another embodiment of the three compartment tray (see FIG. 17) is similar in size and proportion to the embodiment of the three compartment tray in FIG. 14, but has some further refinements. More particularly, the first or primary compartment 14 approximates a semicircle when viewed from above (see FIG. 18). Between the flange surrounding the first compartment 14, a top chamfer or top fillet 90 is provided. Similarly, at the bottom of the sidewall 94, a bottom fillet 92 surrounds the bottom 110 of the first compartment. Extending between the top fillet 90 and the bottom fillet 92 is the side wall 94 of the first compartment 14.

Similarly, the second compartment includes a top chamfer or top fillet 96 surrounding the second compartment and joining the flange to the second compartment side wall 100. At the bottom of the second compartment side wall 100, a fillet 98 extends between that side wall 100 and the substantially flat or generally planar bottom of the second compartment. The second compartment 12, viewed from the top, approximates a quarter-circle, or pie-shaped configuration.

When a third compartment is used, and in this embodiment, the third compartment 55 preferably also includes a top chamfer or top fillet 102 surrounding the third compartment and joining the top flange to the side wall 106 of the third compartment. The side wall 106 extends from the top fillet to a bottom fillet 104 which surrounds the substantially flat or generally planar bottom of the third compartment. Like the second compartment 12, the third compartment may also approximate a quarter-circle or a pie-shaped configuration.

Figure 19:
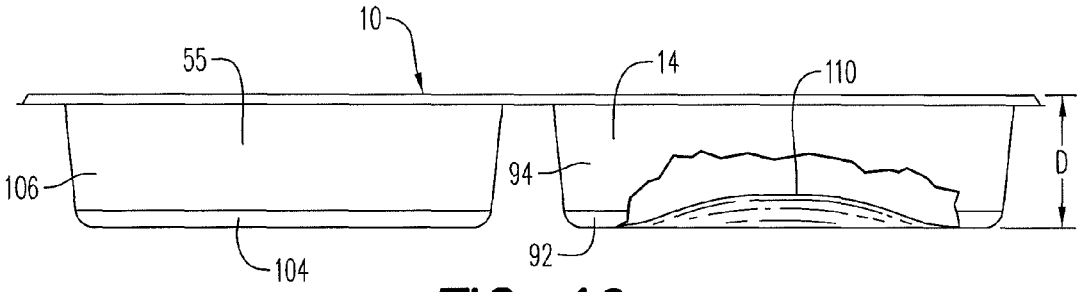
FIG. 19 is a side view of the microwave tray of FIG. 17 with a portion broken away to show the shape of the bottom.
Figure 20:
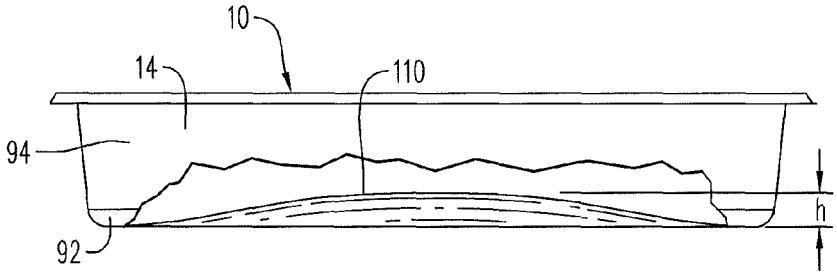
FIG. 20 is an end view of the microwave tray of FIG. 17 with a portion broken away to show the shape of the bottom.
Figure 23:
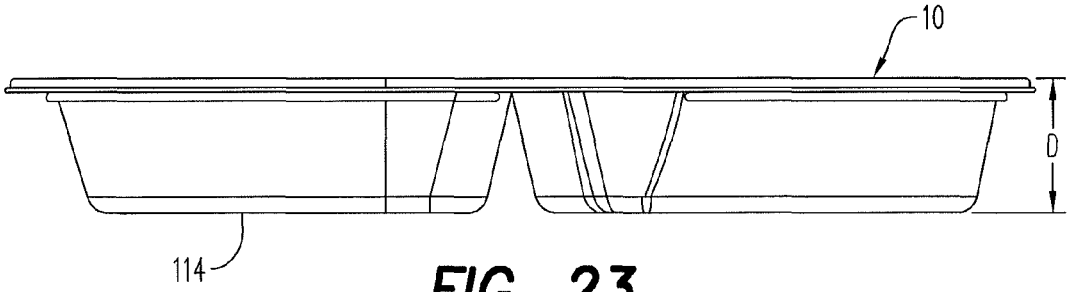
FIG. 23 is a side view of the tray of FIG. 21.

The bottom 110 of the first compartment 14 is curved upwardly into the chamber of the first compartment 14 such that a maximum elevation occurs in the central area of the bottom 110 (see FIG. 19). When viewed in a generally longitudinal cross section, the bottom 110 is preferably curved so as to be convex upwardly from the bottom edge of the surrounding sidewall 94. Moreover, when viewed in a transverse cross section (see FIG. 20), the bottom 110 of the first compartment is curved upwardly into the chamber of the first compartment. Again, the bottom 110 is convex upwardly from the bottom edge of the surrounding sidewall 94 when seen in transverse cross section.

The height h of the domed portion of the bottom 110, preferably is in the range of about 20% to about 35% of the depth D of the first compartment 14. Preferably, the height h is about 25% of the depth D. As discussed above, the domed feature promotes uniform heating of a food product positioned in the first compartment 14.

Yet another embodiment of the three compartment tray 10 (see FIG. 21) includes a first compartment 14, a second compartment 12, and a third compartment each having features as described above. This embodiment, however, includes a number of features that function to increase rigidity of the tray 10 and improve handling characteristics of the tray 10. These features include a non-linear transverse flange 118, a pair of elongate handles 126, 128, and a recessed edge 120, 122, 124 partially surrounding at least one of the compartments.

The non-linear transverse flange 118 (see FIG. 22) may include a pair of substantially straight portions which are angled relative to one another. Preferably the straight portions are symmetrically disposed relative to the longitudinal axis of the tray 10. Preferably, the non-linear transverse flange 118 extends away from the center of the first compartment 14. If desired, the non-linear transverse flange could also be curved or generally arcuate. The offset measured between a line joining the ends of the transverse flange 118 and the greatest deviation of the edge of that flange and that line operates to stiffen the tray 10 against bending in the vertical plane containing the longitudinal axis. The greater that deviation, the greater the stiffening effect.

The pair of handles 126, 128 are substantially parallel to one another and to the longitudinal axis of the tray 10. Preferably, each handle 126, 128 is longer than the width of the flange between the adjacent compartments of the tray. In this way, the handles 126, 128 function to stiffen the edges of the tray 10 at the corresponding ends of the transverse flange 118.

Figure 24:
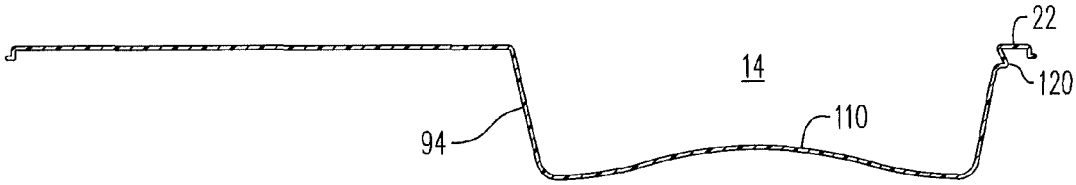
FIG. 24 is a cross-sectional view taken along the line 24-24 of FIG. 22.

Additional stiffening of the tray 10 may be accomplished by including a recessed edge adjacent to the flange and at least partially surrounding at least one of the compartments. More particularly, the first compartment 14 may include a recessed edge 120 extending substantially around the compartment and substantially coextensive with the arcuately shaped portion or curved portion of the side wall 94. That recessed edge 120 (see FIG. 24) cooperates with surface of the flange 22 to define a substantially C-shaped cross section for the flange 22 on the external periphery of the first compartment 14. That C-shaped cross section is stiffer against deflection out of the plane of the flange 22 than a design without such a cross-sectional configuration.

Figure 25:
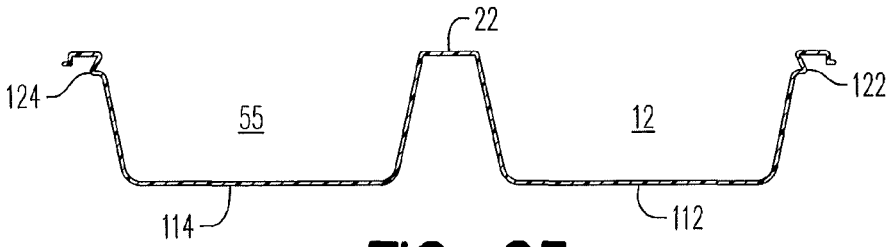
FIG. 25 is a cross-sectional view taken along the line 25-25 of FIG. 22.

Similarly, one or more of the second compartment 12 and the third compartment 55 may include a corresponding recessed edge 122, 124 (see FIG. 25). As with the first compartment 14, the recessed edges 122, 124 are substantially coextensive with the arcuate or curved portion of the corresponding compartment 12, 55. Furthermore, the recessed edges 122, 124 provide the same functionality as the recessed edge 120 discussed above in connection with the first compartment 14.

Preferably, the food products or ingredients selected for use with the microwavable tray described above packaged as individually quick frozen (IQF) products. More particularly, sauces, starches, vegetables, fruits, proteins, and dairy products may be used in the individually quick frozen form. The individually quick frozen products are available, for example, in the form of small cubes, generally spherical particles having a diameter of about one inch, generally hemispherical particles having a diameter of about one inch, as well as other geometric shapes. In any particular compartment of the microwavable tray, combinations of individually quick frozen ingredients may be used. As a result, for example and without limitation, it is possible to provide sauces mixed with starches, sauces mixed with vegetables, sauces mixed with proteins, sauces mixed with dairy products, vegetables mixed with starches, vegetables mixed with proteins, and the like. It should be noted that the individually quick frozen ingredients need not be mixed, but may be provided in layers such that sauces, for example, may be introduced as toppings. In short, use of individually quick frozen ingredients expands the possible range of culinary combinations possible in microwavable packaged foods.

In addition to the flexibility of potential culinary combinations possible, individually quick frozen ingredients introduce further benefits to the microwavable meals possible with the present disclosure. For example, individually quick frozen ingredients function to decrease the amount of cooking time necessary for preparing a microwavable meal. While the specific mechanism is not fully understood at the present time, individually quick frozen may aid the speed with which selected food ingredients reach a desired temperature because the individually quick frozen ingredients have lower density, greater surface area, smaller depth, and tend to heat more rapidly than continuous, monolithic, or block frozen ingredients. Use of individually quick frozen ingredients also reduces the amount of energy required to heat a particular combination of food ingredients to the appropriate serving temperature. That energy reduction is a result of at least the reduced required cooking time for individually quick frozen ingredients.

Where the individually quick frozen ingredients are combined with packaging of the type discussed and described herein, those individually quick frozen ingredients allow the hot food to become hot faster while the cold food remains colder due at least to the reduced time the overall package is exposed to microwave energy. Thus, the incorporation of individually quick frozen ingredients enhances the quality and temperature of the resulting heated meal. The improvement in cooking time for a microwavable meal according to the present invention using individually quick frozen ingredients has been found to be a reduction in cooking time in the range of about 15% to about 35%. For example, using portions of typical size in a microwavable heating tray according to this invention, where the ingredients are supplied in individually quick frozen form, provided a cooking time that was 1 minute and 15 seconds shorter than the cooking time when the ingredients were not supplied in individually quick frozen form. It is anticipated that the cooking time reduction may be less in applications where smaller food portions are employed, such as for example with diet control applications.

Use of individually quick frozen ingredients also improves the textural properties of the resulting food components. For example, pasta may be provided with an "al dente" texture. Again, the specific reasons for this improved characteristic are not fully understood at this time, but are believed to include the minimal moisture migration from component to component where the ingredients are in the individually quick frozen form. With the ability to control moisture migration through use of individually quick frozen ingredients, moisture levels of adjacent or juxtaposed ingredients may be independently selected. This characteristic is not available in conventional monolithic or block frozen components.

When a microwavable tray according to this disclosure has different frozen foods packaged in its various compartments as a microwavable serving for subsequent microwave heating, significant improvements and advantages result. For example, the microwavable serving product or package is a substantial improvement compared to prior art packages at least because a single heating step is used, in contrast to prior art products or packages where a first microwaving step is typically followed by a stirring step which, in turn, is typically followed by a second microwaving step. Accordingly, it is seen that the present invention provides a simple, one-step, microwave heating step to fully prepare the package for use, and the food ingredients for consumer consumption.

The microwavable product or package of this disclosure provides consistent, repeatable temperature in its various compartments. Moreover, those consistent, repeatable temperatures are not the same in all the compartments. The product or package yields optimal heating in each of the various compartments. Moreover, it should be appreciated that this disclosure is not limited to a microwavable product or package having merely two or three compartments. The concepts of this disclosure are applicable to microwavable products or packages having more than three compartments.

While two particular selections of food suitable for use in connection with the present invention have been described and discussed above, it should be appreciated by those skilled in the art that this invention is not limited to those foods. The generality of this invention is better understood when it is considered that a multiplicity of other food combinations may be used in the packaging. More particularly, suitable food combinations include, for example and without limitation: grilled chicken with steamed broccoli and hot fudge sundae; three cheese ziti with green beans and Italian ice; peppercorn beef with green beans and/or mushrooms and sorbet; turkey with mashed potatoes and pumpkin pie; BBQ chicken with baked beans and strawberry shortcake; peppercorn beef with green beans and/or mushrooms and key lime pie; Salisbury steak with macaroni and cheese and asparagus; meatloaf with mashed potatoes and green beans; slow roasted turkey with stuffing and cranberry sauce; rosemary chicken with mashed potatoes and broccoli; beef teriyaki with rice and pineapple; sesame chicken with rise and oranges; turkey with stuffing and cranberries; pancakes and maple syrup with strawberries; cheesy scramble having turkey sausage with mixed berries; egg omelet with hash brown potatoes and mixed fruit; oatmeal with blueberries; ham and cheese scrambled eggs with hash browns and cinnamon roll; three cheese egg omelet with turkey sausage and blueberry muffin; oatmeal with banana nut muffin and blueberries; Asian chicken salad; southwest chicken salad; BBQ chopped chicken salad; buffalo chicken salad; potatoes with broccoli, cheddar and bacon; potatoes with chicken, bacon and ranch dressing; potatoes with chili and sour cream; potatoes with tuna au gratin; sandwich with cole slaw; sandwich with fruit salad; sandwich with broccoli salad; sandwich with pasta salad; broccoli cheddar soup with turkey; tomato soup with whole grain cheese bread; chili with corn bread; chicken ranchero wrap with ranch dip; mini cheeseburger with ketchup; boneless chicken winds with blue cheese dip; chicken and cheese quesadilla with queso; chicken and cheese quesadilla with salsa; and other combinations of one food item and at least a second food item, where the first and second food items are desirably served at different temperatures.

Where, for example, one compartment includes a salad and another compartment includes a salad topping, the package may be heated so that the topping is heated or warmed so as to be dumped on or spread over the salad portion. Any such combination of foods from different compartments may be performed in the microwavable tray itself or in a separate dish, as desired.

In this specification, the word "about" is often used in connection with a numerical value to indicate that mathematical precision of such value is not intended. Accordingly, it is intended that where "about" is used with a numerical value, a tolerance of 10% is contemplated for that numerical value.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions. In this connection, the term "rounded" is intended to also include configurations comprising two or more substantially straight line segments describing the "rounded" feature.

While the foregoing describes in detail a microwave heating tray, methods of making the tray, and methods of use, it will be apparent to one skilled in the art that various changes and modifications may be made to the disclosed tray and methods and further that equivalents may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A microwave heating support comprising:

a tray having a smoothly contoured peripheral shape substantially free of sharp corners and formed of a microwave safe plastic or paper material, said tray including at least:

a first integral compartment defined by at least one sidewall and an upwardly convex bottom; and a second integral compartment defined by at least one sidewall and a generally planar bottom, wherein the first integral compartment is spaced from the second integral compartment by a distance sufficient to provide thermal insulation between the compartments the shape and spacing of the compartments resulting in uniform heating within each individual compartment.

2. The microwave heating support of claim 1, wherein the smoothly contoured peripheral shape is selected from the group consisting of round, elliptical, and oval contours.

3. The microwave heating support of claim 1, wherein at least one of the first and second integral compartments further includes a microwave energy limiting structure.

4. The microwave heating support of claim 3, wherein the microwave energy limiting structure includes a material selected from the group consisting of foil, microwave absorbing material, microwave transmitting material, microwave reflecting material, and combinations thereof.

5. The microwave heating support of claim 3, wherein the microwave energy limiting structure includes at least one opening.

6. The microwave heating support of claim 1, wherein the first integral compartment contains a first quantity of food and the second integral compartment contains a second quantity of food.

7. The microwave heating support of claim 6, wherein the first quantity of food and the second quantity of food have different densities and/or heating characteristics.

8. The microwave heating support of claim 6, wherein one of the first quantity of food and the second quantity of food is in the form of pellets.

9. The microwave heating support of claim 8, wherein the pellets are individually quick frozen food ingredients.

10. The microwave heating support of claim 1, wherein one of the first and second compartments contains first individually quick frozen ingredients.

11. The microwave heating support of claim 1, wherein one of the first and second compartments contains at least two individually quick frozen ingredients.

12. The microwave heating support of claim 1, wherein the second compartment contains individually quick frozen ingredients.

13. The microwave heating support of claim 1, wherein the second compartment contains at least two individually quick frozen ingredients.

14. The microwave heating support of claim 1, wherein the upwardly convex bottom has a domed central portion and a lower, outer edge and the food located at the lower, outer edge is thicker than the food located at the domed central portion.

15. The microwave heating support of claim 14, wherein the domed central portion is offset from the lower, outer edge by about 0.1 inch to about 1.0 inch.

16. The microwave heating support of claim 1, wherein adjacent portions of the sidewalls of the first integral compartment and the second integral compartment diverge in a downward direction.

17. The microwave heating support of claim 1, further including at least three compartments.

18. A microwave container comprising:

a tray having a smoothly contoured peripheral shape substantially free of sharp corners and formed of a microwave safe plastic or paper material, said tray including at least:

a first integral compartment defined by at least one sidewall and an upwardly convex bottom;

a second integral compartment defined by at least one sidewall and agenerally planar bottom;

a first quantity of food contained in the first integral compartment; and a second quantity of food contained in the second integral compartment, wherein the first integral compartment is spaced from the second integral compartment by a distance sufficient to provide thermal insulation between the compartments, the shape and spacing of the compartments resulting in uniform heating within each individual compartment, and wherein at least one of the first and second compartments includes a microwave energy limiting structure.

19. The microwave container of claim 18, wherein the microwave energy limiting structure includes a material selected from the group consisting of foil, microwave absorbing material, microwave transmitting material, microwave reflecting material, and combinations thereof.

20. The microwave container of claim 18, wherein the microwave energy limiting structure includes at least one hole therein.

21. The microwave container of claim 18, wherein the first quantity of food and the second quantity of food have different densities and/or heating characteristics.

22. The microwave container of claim 18, wherein one of the first quantity of food and the second quantity of food is in the form of pellets.

23. The microwave container of claim 18, wherein one of the first quantity of food and the second quantity of food comprises individually quick frozen ingredients.

24. The microwave container of claim 18, wherein one of the first quantity of food and the second quantity of food comprises at least two individually quick frozen ingredients.

25. The microwave container of claim 18, wherein the upwardly convex bottom has a domed central portion and a lower, outer edge and the food located at the lower, outer edge is thicker than the food located at the domed central portion.

26. The microwave container of claim 25, wherein the domed central portion is offset from the lower, outer edge by about 0.1 inch to about 1.0 inch.

27. The microwave container of claim 18, wherein adjacent portions of the sidewalls of the first integral compartment and the second integral compartment diverge in a downward direction.

28. The microwave container of claim 18, wherein the microwave energy limiting structure is removable.

29. The microwave container of claim 18, further including lidding material covering at least the first and second compartments, and being sealed to the tray so as to substantially isolate the first and second integral compartments from one another.

30. The microwave container of claim 29, wherein the lidding material is sealed to the tray substantially along the smoothly contoured peripheral shape thereof and offset from the periphery toward the center of the container.

31. A method of packaging multiple foods for microwave heating to different temperatures comprising the steps of:

providing a microwavable plastic or paper tray having a smoothly contoured peripheral shape substantially free of sharp corners, multiple food receiving compartments spaced from one another sufficient to provide thermal insulation between the compartments, a first food-receiving compartment having an upwardly convex bottom surface; the shape and spacing of the compartments resulting in uniform heating within each individual compartment placing a first food in a first food-receiving compartment of the tray such that the first food has a greater thickness at peripheral portions thereof than at central portions thereof, so that upon exposure to microwave energy for a predetermined time period the temperature of the first food reaches a corresponding first temperature;

placing a second food in a second food-receiving compartment of the tray;

at least partially covering at least one of the first and second food-receiving compartments with a microwave modulating structure, so that upon exposure to the microwave energy for the predetermined time period the temperature of the second food reaches a corresponding second temperature which is different than the first temperature; and covering one of the first and second food-receiving compartments with a substantially microwave transparent structure.

32. The method of claim 31, wherein the microwave modulating structure reduces the microwave energy entering the second food-receiving compartment by at least about 25%.

33. The method of claim 31, including the further step of providing at least one of the first food and the second food in pelletized form.

34. The method of claim 31, including the further step of providing at least one of the first food and the second food as individually quick frozen ingredients.

35. The method of claim 31, including the further step of providing at least one of the first food and the second food as a plurality of individually quick frozen ingredients.

* * * * *

UNITED STATES PATENT AND TRADEMARK OFFICE

CERTIFICATE OF CORRECTION

PATENT NO. : 8,445,043 B2
APPLICATION NO. : 12/982486
DATED : May 21, 2013
INVENTOR(S) : Daniel C. Jackson et al.

It is certified that error appears in the above-identified patent and that said Letters Patent is hereby corrected as shown below:

On the Title Page, at Item (75) Inventors, of the printed patent, "Elizabeth Ritchey" should read --Beth A. Ritchey--.

In the Specification

At column 6, line 16 of the printed patent, "thinner" should read --thicker--.

At column 11, line 55 of the printed patent, "tray" should read --compartment--.

At column 11, line 67 of the printed patent, "tray" should read --compartment--.

At column 12, line 26 of the printed patent, "first and second" should read --second and third--.

At column 12, line 48 of the printed patent, "second and third" should read --first, second, and third--.

At column 16, line 51 of the printed patent, "rise" should read --rice--.

Signed and Sealed this
Twenty-second Day of October, 2013

Teresa Stanek Rea

Teresa Stanek Rea
*Deputy Director of the United States Patent and Trademark Office*